US006561665B1

(12) United States Patent
Kim

(10) Patent No.: US 6,561,665 B1
(45) Date of Patent: May 13, 2003

(54) LIGHTING SIGNBOARD HAVING A CURVED STRUCTURE

(76) Inventor: In-Chul Kim, 11/404, Daelim APT., Bupyeong 1-dong, Bupyeong-gu, Incheon 403-763 (KR)

( * ) Notice: Subject to any disclaimer, the term of this patent is extended or adjusted under 35 U.S.C. 154(b) by 0 days.

(21) Appl. No.: 10/097,134

(22) Filed: Mar. 14, 2002

(51) Int. Cl.[7] ..... F21V 7/04
(52) U.S. Cl. ..... 362/31; 362/559; 362/30
(58) Field of Search ..... 362/31, 26, 30, 362/330, 551, 33, 559, 125, 236; 40/541, 546, 547; 349/63, 65

(56) References Cited

U.S. PATENT DOCUMENTS 6,247,826 B1 * 6/2001 Funamoto et al. ..... 362/31
2002/0126086 A1 * 9/2002 Takeuchi et al. ..... 345/156

FOREIGN PATENT DOCUMENTS

JP 2000105557 A * 4/2002

* cited by examiner

*Primary Examiner*—Sandra O'Shea
*Assistant Examiner*—Hargobind S. Sawhney
(74) *Attorney, Agent, or Firm*—Fleshner & Kim, LLP

(57) ABSTRACT

The present invention relates to a lighting signboard having a curved structure. The above lighting signboard having a curved structure includes a light guide plate which is formed in a curved plate shape for thereby being attached to an outer surface of a circular column structure, a back plate which supports the light guide plate, and a front plate which implements a lighting by a light from the light guide plate and supports the advertisement plate which is curved along the shape of the circular column structure. A diffused reflection member is inserted in a portion remotely distanced from the light source for thereby scatter-spreading the light from both ends of the same, and the light from the light source is spread through the light guide plate for thereby lighting an advertisement film attached on a front surface of the light guide plate.

5 Claims, 4 Drawing Sheets

LIGHTING SIGNBOARD HAVING A CURVED STRUCTURE

BACKGROUND OF THE INVENTION

1. Field of the Invention

The present invention relates to a lighting signboard, and in particular to a lighting signboard which is curved for being installed on a circular surface of a certain element such as a circular column and which is capable of effectively lighting the entire portions of a signboard using a minimum light source.

2. Background of the Related Art

Generally, an advertising signboard is formed in a rectangular shape and is installed on an indoor wall surface of a certain structure such as in a subway station. The above signboard is preferably protruded and installed on the surface of a wall.

In the case that a luminous intensity is low in an installation site, the signboard has a lighting element in the interior of the same for thereby lighting an advertisement attached on a front surface of the lighting signboard in a backward direction of the signboard, so that a customer sees an advertisement in an area such as a subway station in which a luminous intensity is low.

As shown in FIG. 4, a conventional signboard is formed of a housing 100, a fluorescent light 110, and an advertisement screen 120.

The housing 100 is formed in a box shape in which a front surface of the same is open and has a certain space therein for installing a plurality of elements therein.

The fluorescent light 110 has a certain size which is in proportion to the size of an inner space of the housing 100. A certain number of the fluorescent lights 110 are installed in a vertical or horizontal direction based on the size of the advertisement screen 120. As the electric charges are activated based on an external power, the luminous substances emit light.

The advertisement screen 120 is formed of a synthetic resin such as a transparent or semi-transparent acryl for thereby transmitting a light from the fluorescent light 110 therethrough. A certain advertisement graphic or character is printed or attached on a front surface of the advertisement screen 120.

Therefore, all portions of the back surface of the housing 100 or a part of the same are inserted into a wall surface of a passage of a subway station. The fluorescent light 110 connected with a power apparatus such as a power and switch is installed in the interior of the housing 100. The advertisement screen 120 on which an advertisement is attached or printed, is attached to an open front surface of the housing 100.

When a power is applied to the fluorescent light 110 based on a selective operation of the power apparatus, the fluorescent lights 110 emit light in a certain luminous range. The emitted light transmits through the advertisement screen 120 which is attached in a certain size, for thereby lighting a certain advertisement printed or attached on a front surface of the advertisement screen 120.

Since the conventional signboard is formed in a plate shape or a rectangular box shape, it is impossible to install the signboard in a certain circular column structure such as a circular column installed for example in a subway station.

In the conventional signboard, since an advertisement screen on which a certain advertisement is attached or printed is formed in a plate shape, it is impossible to install the signboard in a circular column structure.

In the conventional signboard, a plurality of fluorescent lights each having a certain lighting range are installed in the interior of the housing. Since an advertisement screen is installed based on a lighting range of each fluorescent light, and a certain advertisement is attached or printed on the signboard, a certain number of the fluorescent lights are required based on the lighting range of the fluorescent lights and the size of the advertisement. Therefore, a certain element such as a fluorescent light is additionally needed for the signboard. The power consumption for the fluorescent lights is increased.

In the conventional signboard in which a plurality of fluorescent lights are installed based on the size of an advertisement, and a power apparatus is provided for applying a power to the fluorescent lights, the number of the fluorescent lights for lighting an advertisement and an additional installation of the power apparatus are limited based on a voltage limit or a heating due to an over flow of the voltage in the fluorescent light and power apparatus, so that the size of the advertisement is limited.

SUMMARY OF THE INVENTION

Accordingly, it is a first object of the present invention to provide a lighting signboard having a curved structure which overcomes the problems encountered in the conventional art.

It is a second object of the present invention to provide a lighting signboard having a curved structure which is capable of being installed in a circular column structure for thereby installing a lighting signboard in various structures and installing a certain advertisement in various structures.

It is a third object of the present invention to provide a lighting signboard having a curved structure which is capable of lighting a signboard based on a minimum light source and a power apparatus therefor.

It is a fourth object of the present invention to provide a lighting signboard having a curved structure which is capable of more efficiently lighting a signboard based on a minimum light source.

To achieve the above objects, there is provided a lighting signboard having a curved structure which is capable of being attached to an outer surface of a circular column structure.

To achieve the above objects, there is provided a lighting apparatus having a curved structure which is capable of being attached to a circular column structure.

To achieve the above objects, there is provided an advertisement plate having a curved structure which is capable of being attached to a circular column structure.

To achieve the above objects, there is provided a light guide plate which is capable of implementing an effective lighting with respect to a front surface of an advertisement plate using a light source installed at both side ends of an advertisement plate.

To achieve the above objects, there is provided a diffused reflection member installed in multiple portions of a light guide plate, so that a light from a light source installed at both side ends of an advertisement plate is effectively spread beyond a spreading range of the light source and lights an advertisement plate installed in the front surface of the same.

To achieve the above objects, there is provided a lighting signboard having a curved structure in which a diffused reflection member installed in a light guide plate near a light source and a diffused reflection member installed in a light guide plate distanced from the light source have different densities each other, so that a light from the light source installed at both side ends of the advertisement plate is spread beyond a spreading range of the light source.

BRIEF DESCRIPTION OF THE DRAWINGS

The present invention will become better understood with reference to the appended drawings which are given only by way of illustration and thus are not limitative of the present invention, wherein.

DETAILED DESCRIPTION OF THE PREFERRED EMBODIMENTS

The preferred embodiments of the present invention will be explained with reference to the appended drawings.

Figure 1:
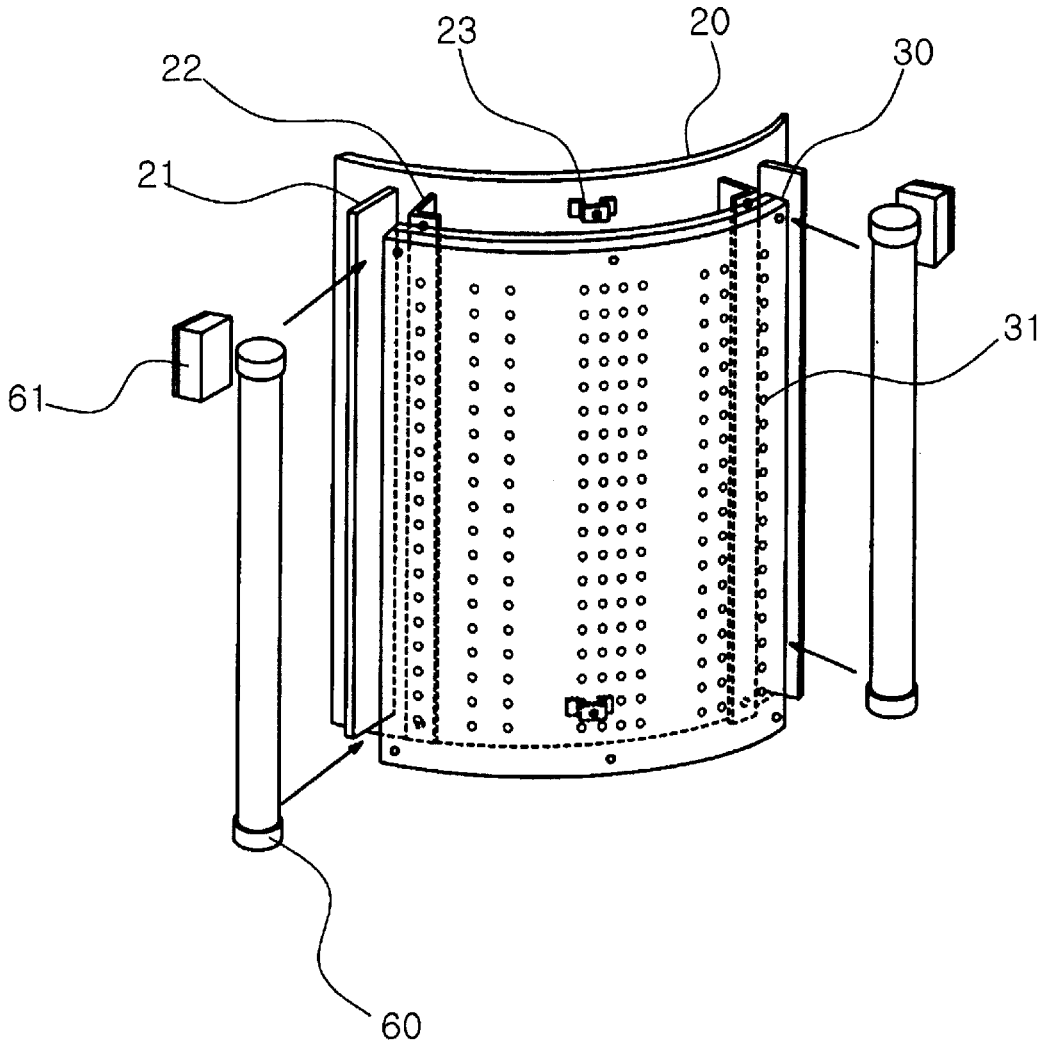
FIG. 1 is a perspective view illustrating a back plate of a lighting signboard according to the present invention.
Figure 2:
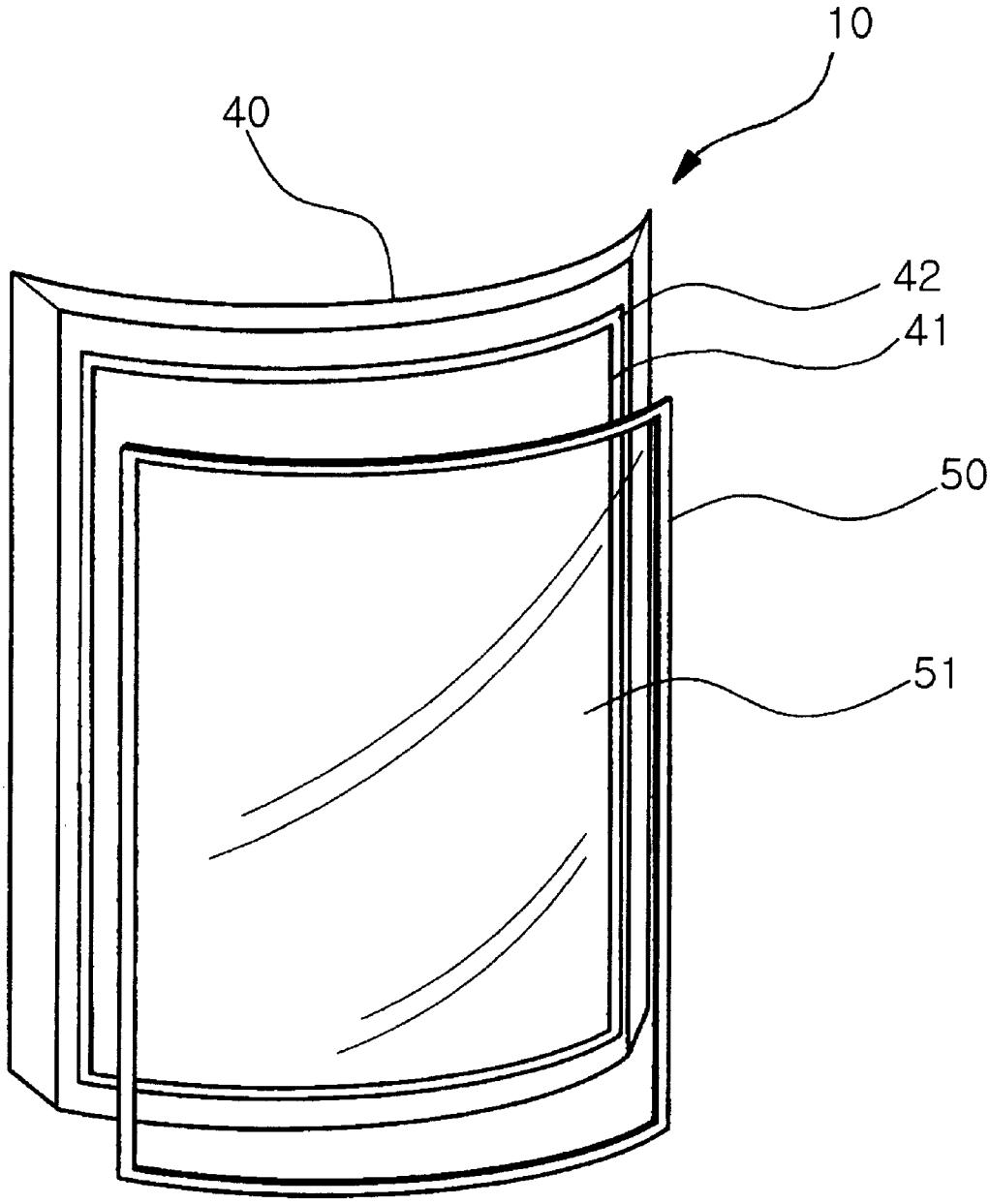
FIG. 2 is a perspective view illustrating a front plate of a lighting signboard according to the present invention.
Figure 3:
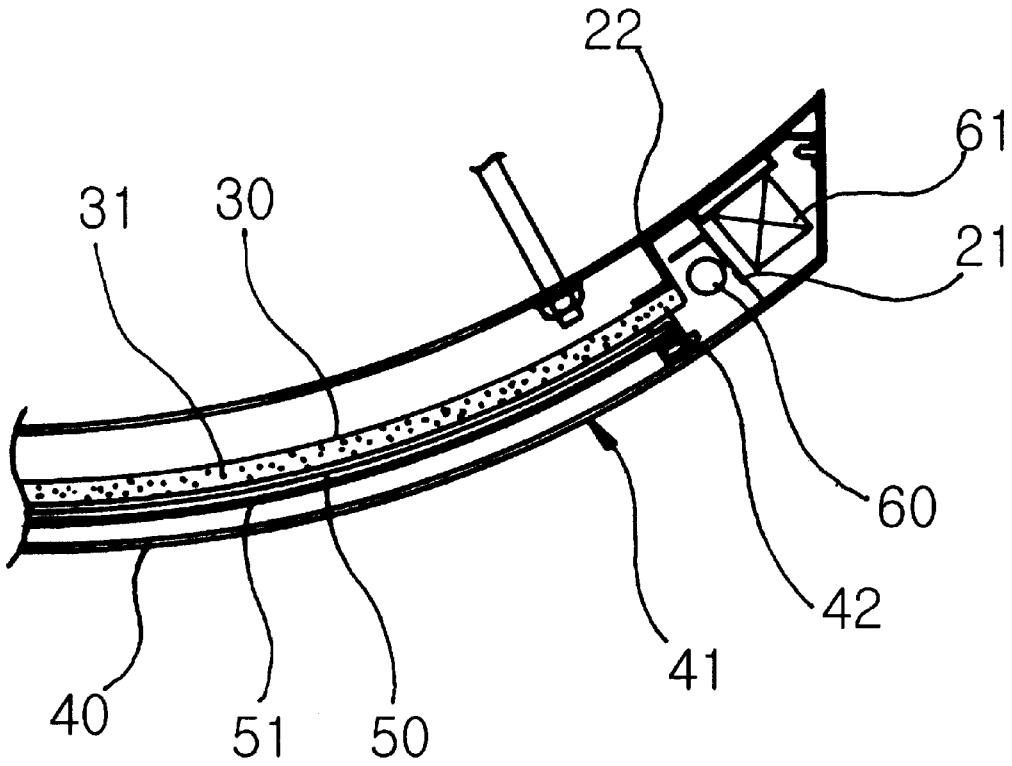
FIG. 3 is a partial cross-sectional view illustrating a lighting signboard according to the present invention.
Figure 4:
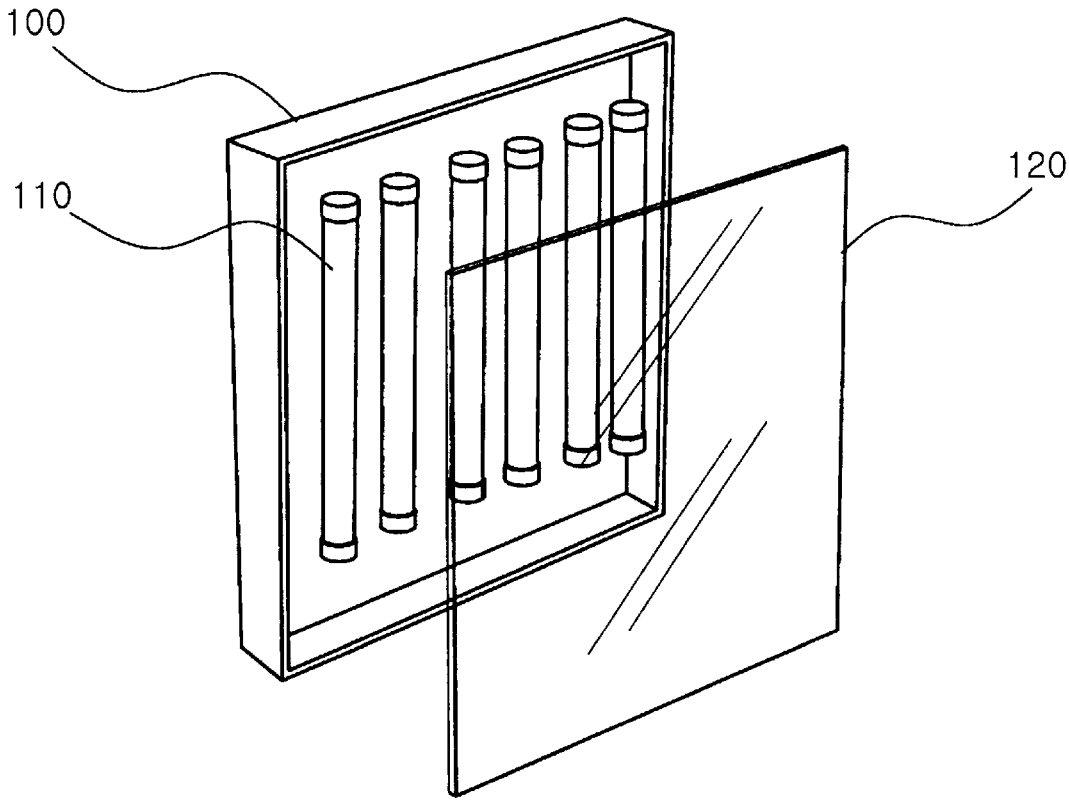
FIG. 4 is a perspective view illustrating a conventional lighting signboard.

FIGS. 1 through 3 are views illustrating a lighting signboard having a curved structure according to the present invention. As shown therein, the lighting signboard having a curved structure according to the present invention includes a back plate 20, a light guide plate 30, a front plate 40, an advertisement plate 50, a light source 60 and a power 61.

The back plate 20 includes a partition member 21, a support member 22 and a fixing member 23.

The partition member 21 is formed in a rectangular shape for separating the power 61 and the light source 60 installed at both sides of the back plate 20 and is arranged in a vertical direction with respect to the back plate 20 at front both sides of the back plate 20 distanced by the size of the power 61.

In addition, the partition member 21 reflects a light, which is outputted in a certain direction opposite to the direction that the light guide plate 30 is positioned, among the lights from the light source 60 in the direction of the light guide plate 30.

The support member 22 is protruded in a rectangular shape in the front direction from the front surfaces of both sides of the back plate 20 in such a manner that both ends of the guide plate, which guide a light from the light source 60 for being outputted into a certain space, are distanced from the back plate 20 and are fixedly supported. In addition, the support member 22 is vertically bent in a center direction of the back plate 20.

The fixing member 23 is formed in a plate shape and is protruded from the front surface of the center upper and lower portions of the back plate 20 in such a manner that the upper and lower portions of the light guide plate 30 attached on the front surface of the back plate 20 are fixedly supported. A plurality of ribs are formed on the entire portions of the back plate 20, so that the back plate 20 is distanced from the back plate 20 by a certain interval.

Here, the support member 22 and the fixing member 23 each include bolt holes on an outer side surface contacting with the light guide plate 30 for thereby being joined with the light guide plate 30 using bolts.

The protruded widths of the support member 22 and the fixing member 23 are same.

The back plate 20 includes an outwardly protruded center portion which closely contacts with an outer surface of the circular column structure and includes a plurality of bolt holes for thereby being joined with the structure using bolts.

The light guide plate 30 guides a light from the light source into a certain space and is formed of a synthetic resin material such as an acryl which is capable of transmitting and guiding light, so that a light of a certain intensity is outputted to the outside and includes an outwardly protruded center portion for being attached to the front surface of the back plate 20.

The light guide plate 30 is formed of two light guide plates based on a melting or uniting method, each having a certain thickness (preferably about 6 mm) for thereby effectively guiding a light from the light source 60.

In addition, the light guide plate 30 includes a plurality of diffused reflection members 31 by which a light from the light source 60 is spread beyond a light spreading range of the light source, and the light is effectively outputted in the direction of the advertisement plate 50 installed in the front surface of the same.

The light guide plate 30 implements the operations that the light from the light source 60 is outputted based on the shape of the light guide plate 30 and the inner structure of the same, a part of the light from the light source 60 is outputted to an outer side of the light guide plate 30 based on the incident angle of the light, and a part of the light is outputted based on the shape of the light guide plate 30.

The diffused reflection member 31 is formed of a silicon or glass material in a curved shape, so that the light outputted based on the shape and structure of the light guide plate 30 forms a diffused reflection for thereby outputting the light in an outer direction of the light guide plate 30 and is embedded in the multiple portions of the light guide plate 30.

The diffused reflection member 31 includes a density which is larger in a portion distanced from the light source 60 compared to the density in a portion near the light source 60, so that the light is uniformly spread onto the entire surfaces of the light guide plate 30 irrespective of the light spreading range of the light source 60.

A plurality of bolt holes are formed in a plurality of outer portions of the light guide plate 30 contacting with the bolt holes formed in the support member 22 and the fixing member 23, so that the bolts assembled into the bolt holes pass through the same.

As shown in FIG. 2, an outer portion of the front plate 40 is joined with an outer portion of the back plate 20, and the front plate 40 is formed in a rectangular box shape which is upwardly opened, in which the light guide plate 30, the light source 60 and the power 61 are installed.

The front plate 40 includes an outwardly protruded center portion formed along a curved portion of the back plate 20 and has a circular cross section.

The front plate 40 includes an opened rectangular light outputting window 41 through which a light from the light guide plate 30 is forwardly outputted.

A joining member 42 is formed in a concave shape stepped from an outer end to an inner side of the light outputting window 41, and a plurality of ribs are formed in the direction of the center of the light outputting window 41.

The ribs of the joining member 42 each have a certain thickness similar with the interval of the gap between the light guide plate 30 and the advertisement plate 50 for thereby forming a certain distanced gap between the light guide plate 30 and the advertisement plate 50.

The advertisement plate 50 is formed of a transparent or semi-transparent synthetic resin through which a light from the light guide plate 30 is transmitted and includes a vertically curved center portion which corresponds to the outer shape of the circular structure.

The advertisement plate 50 is fixedly joined with the joining member 42 formed in an outer end of the light outputting window 41 in its outer portion. At this time, the light guide plate 30 and the advertisement plate 50 are distanced by a certain interval for thereby preventing a light from the light guide plate 30 from being reflected by the surfaces of the light guide plate 30 and the advertisement plate 50.

The advertisement film 51 is formed of a thin film attached to the advertisement plate 50, and a certain advertisement is printed on the front surface of the same in a graphic and character form.

The light source 60 is fixed between the partition member 21 and the support member 22 of the back plate 20 and preferably has the same length as the vertical length of the back plate 20.

The light source 60 is preferably formed of a fluorescent light, so that a lighting member installed in the interior outputs light as an electric power is externally applied to the power 61.

The electric power is connected with the external power 61 and is formed of a power stabilizer, so that the power is rectified and transformed into a proper power, whereby the light is effectively outputted from the light source 60.

The back plate 20 and the front plate 40 are joined each other using the bolts installed in the outer surface of the circular structure and are inserted by a certain depth in the outer surface of the circular column structure.

The operation of the lighting signboard having a curved structure according to the present invention will be explained.

The lighting signboard 10 according to the present invention is installed in an outer surface of the circular column installed for example in a subway station, and the power 61 installed at both sides of the back plate 20 of the lighting signboard 10 is connected with an external power.

As the external power is applied, the external power is transformed into a proper power which can be applied from the power 61 to the light source 60 for thereby supplying the power.

The power transformed by the power 61 is applied to the light source 60, and the lighting member of the light source 60 output light, and the outputted light is inputted into the interior of the light guide plate 30 near the light source 60.

The light inputted into the interior of the light guide plate 30 is outputted based on the shape and inner structure of the light guide member and a part of the light inputted into the interior of the light guide plate 30 is outputted to the outside of the light guide plate 30 based on the different incident angle of the light.

The light inputted into the interior of the light guide plate 30 is scatter-reflected by the diffused reflection member 31 installed in the light guide plate 30 and is outputted to the outside of the light guide plate 30.

Since the diffused reflection member 31 has the different density based on the distance from the light source 60 in the portion in which the density of the diffused reflection member 31 is high, the above light is scatter-reflected, and more light is outputted in an outer direction, so that the light is uniformly outputted onto the entire surface of the light guide plate 30.

The light outputted to the outside of the light guide plate 30 transmits through the advertisement plate 50 installed at a certain distance from the light guide plate 30, and the light which transmitted the advertisement plate 50 lights the advertisement attached on the front surface of the advertisement plate 50 in an inward direction.

Here, the light outputted to the outer portion by the light guide plate 30 has a certain speed and incident angle in a certain space between the light guide plate 30 and the advertisement plate 50 and transmits from the back surface to the front surface of the advertisement plate 50.

As described above, in the present invention, it is possible to install a signboard in various structures having a curved surface such as a circular column which needs lighting, so that a lighting signboard may be installed in various structures.

In addition, in the present invention, it is possible to light an advertisement material using a minimum lighting, and the number of apparatuses needed for lighting is decreased, and the fabrication cost of the signboard is significantly decreased.

In the present invention, it is possible to uniformly light onto the entire surface of the advertisement plate through the light source and light guide plate installed in the advertisement plate, so that a fabrication and maintenance cost is decreased, and it is possible to implement a long time lighting advertisement of the advertisement plate.

As the present invention may be embodied in several forms without departing from the spirit or essential characteristics thereof, it should also be understood that the above-described embodiments are not limited by any of the details of the foregoing description, unless otherwise specified, but rather should be construed broadly within its spirit and scope as defined in the appended claims, and therefore all changes and modifications that fall within the meets and bounds of the claims, or equivalences of such meets and bounds are therefore intended to be embraced by the accompanying claims.

What is claimed is:

1. A lighting signboard having a curved structure, comprising:

a curved light guide plate which transmits and outputs a light from a light source into a predetermined space and has a center portion curved along an outer surface of a circular column structure;

a back plate which includes at least support member formed in a plate shape distanced from the back plate in such a manner that both side ends of the light guide plate are fixedly disposed therein, and a fixing member formed in a plate shape distanced from the back plate in such a manner that upper and lower portions of the light guide plate are fixedly disposed, and the center portion of the back plate is attached on an outer surface of the circular column structure based on the shape of the light guide plate;

a front plate which includes a light outputting window having an opened portion through which a light from the light guide plate is outputted, and a joining member formed in a concave shape stepped in the direction from the outer portion of the light outputting window to an inner side of the same and including ribs formed in the direction of the center of the light outputting window and receives the light guide plate installed in the back plate therein and is joined with an outer portion of the back plate;

an advertisement plate which includes a curved center portion for thereby being joined with the joining member of the front plate in its outer portion and to which an advertisement film and printed advertisement material are joined on the front surface of the same; and a power which generates a light outputted to the light guide plate and applies a current to the light source installed in the back plate.

2. The signboard of claim 1, wherein a diffused reflection member is installed in the interior of the light guide plate for scatter-reflecting a light from the light source and outputting to the advertisement plate installed in an outer side of the light guide plate.

3. The signboard of claim 2, wherein said diffused reflection member has a density which is larger in a portion distanced from the light source compared to a portion near the light source and is installed in the interior of the light guide plate.

4. The signboard of claim 1, wherein a partition member is installed in the back plate in one side of the light source opposite to the light guide plate, so that a light from the light source is guided in a direction of the light guide plate.

5. The signboard of claim 1, wherein said joining member supports an outer portion of the back surface of the advertisement plate and includes ribs each having the same thickness as the distance between the light guide plate and the advertisement plate.

* * * * *